US005915645A

United States Patent [19]

Granger

[11] Patent Number: 5,915,645

[45] Date of Patent: Jun. 29, 1999

[54] LOADING DEVICE FOR DISPENSING APPARATUS FOR MATERIAL WIPES

[76] Inventor: Maurice Granger, 17 Rue Marcel Pagnol, 42270 Saint Priest En Jarez, France

[21] Appl. No.: 08/913,383

[22] PCT Filed: Feb. 28, 1996

[86] PCT No.: PCT/FR96/00305

§ 371 Date: Dec. 12, 1997

§ 102(e) Date: Dec. 12, 1997

[87] PCT Pub. No.: WO96/28080

PCT Pub. Date: Sep. 19, 1996

[30] Foreign Application Priority Data

Mar. 15, 1995 [FR] France ..... 95.03312

[51] Int. Cl.[6] ..... B65H 16/06

[52] U.S. Cl. ..... 242/560; 242/596.3

[58] Field of Search ..... 242/560, 596, 242/596.1, 596.2, 596.3, 596.4, 596.8

[56] References Cited

U.S. PATENT DOCUMENTS

| | | | |
|---|---|---|---|
| 2,896,871 | 7/1959 | Woodruff | 242/596.3 |
| 2,904,274 | 9/1959 | Hicks | 242/596.3 |
| 2,905,405 | 9/1959 | Burton et al. | 242/596.1 |
| 2,908,449 | 10/1959 | Bolger | 242/596.1 |
| 3,039,709 | 6/1962 | Bolger | 242/596.3 |
| 3,271,090 | 9/1966 | Smithers | 242/560 |
| 3,865,295 | 2/1975 | Okamura | 242/560 |
| 4,213,363 | 7/1980 | Granger . | |
| 4,383,657 | 5/1983 | Suh | 242/596.3 |
| 4,522,346 | 6/1985 | Jespersen | 242/596.3 |
| 4,635,837 | 1/1987 | Granger . | |
| 4,756,485 | 7/1988 | Bastian et al. . | |
| 5,161,723 | 11/1992 | Wirtz-Odenthal . | |
| 5,249,755 | 10/1993 | Jespersen . | |

FOREIGN PATENT DOCUMENTS

| | | |
|---|---|---|
| 1036952 | 7/1966 | Switzerland . |
| 1180183 | 2/1970 | United Kingdom . |
| 2028765 | 12/1980 | United Kingdom . |

*Primary Examiner*—John P. Darling
*Attorney, Agent, or Firm*—Wall Marjama Bilinski & Burr

[57] ABSTRACT

The housing of the apparatus comprises lateral walls (2*b*–2*c*) perpendicular to the rear wall (2*a*) and designed to have curved slots (2*g*) and at least one projecting shape (9) shaped in the form of a cam situated at the rear end of each curved slot. Opposite each wall (2*b*–2*c*) there is a small hinged shaped plate (11) capable of elastic deformation accommodating a retractable pin (12) arranged opposite the wall of the housing in order to fit into, protrude beyond or retract from said curved receptacle slot in combination with elastic deformation of the small plate of which the lower part is capable of cooperating as it moves with projection (9) formed on the opposite wall depending on the particular reel loading phase. The small plate is restored to its initial position at the end of operation. The diameter of pin (12) is much less than the diameter of the core. This loading device is suitable for any type of dispensing apparatus for paper wipes.

9 Claims, 7 Drawing Sheets

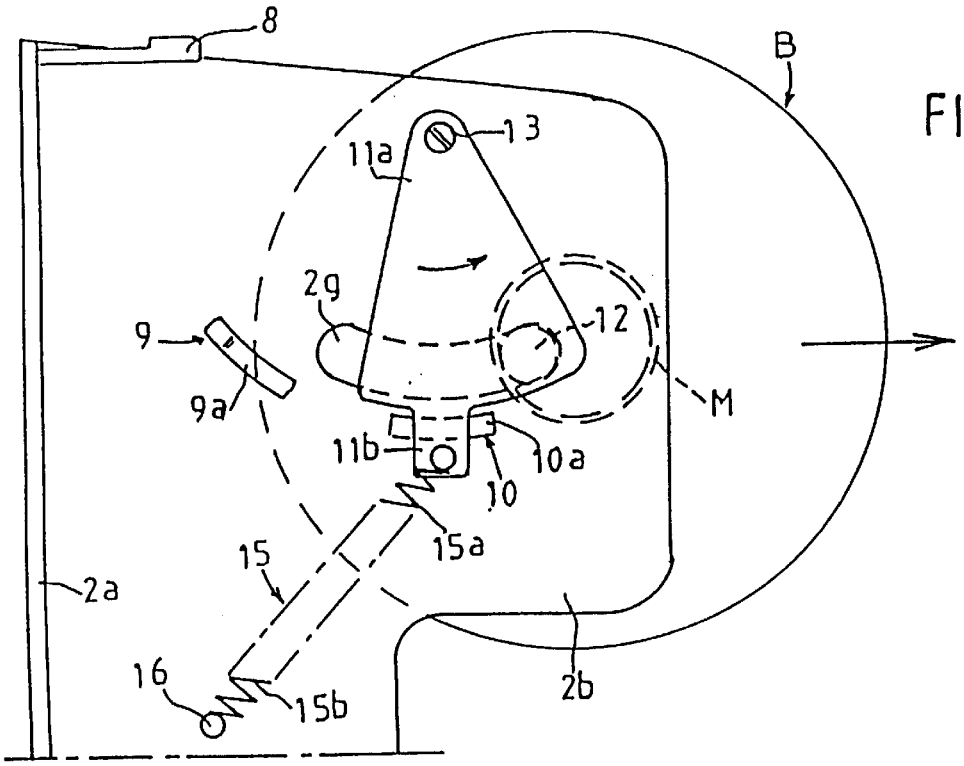
FIG.6
FIG.5
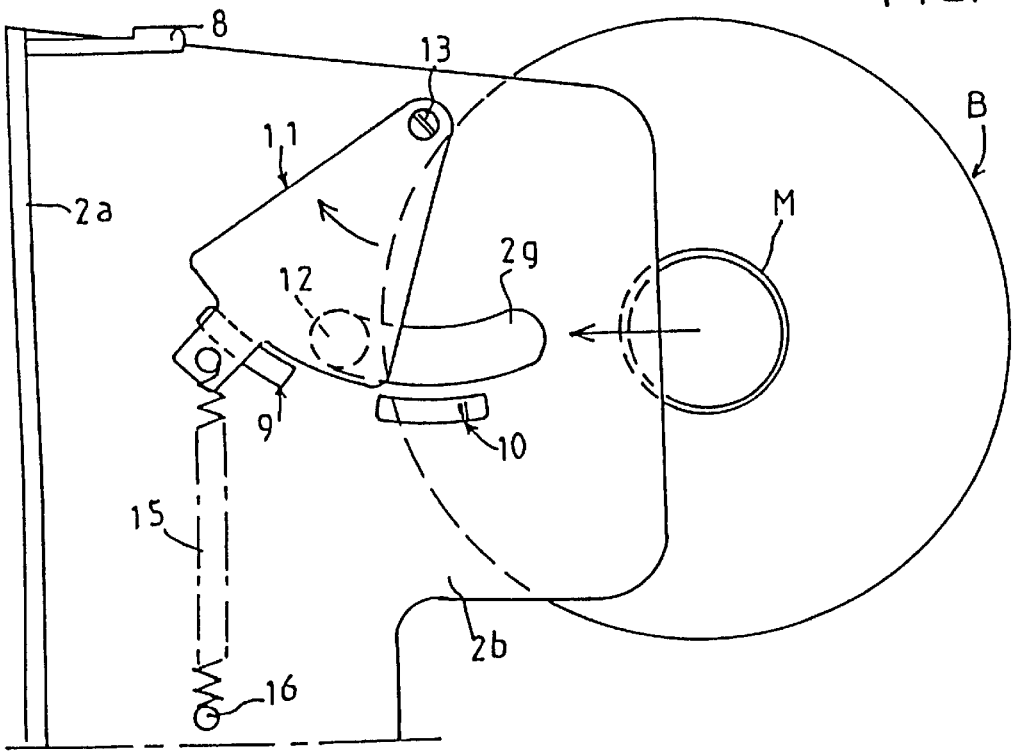

LOADING DEVICE FOR DISPENSING APPARATUS FOR MATERIAL WIPES

BACKGROUND OF THE INVENTION

The invention relates to the technical sector of apparatus for dispensing cellulose wadding, creped paper towels and towels of similar materials, especially those used for wiping the user's hands, toilet paper and paper napkins.

It is known in the trade that numerous manufacturers, producers and the present applicant in particular offer dispensing apparatus for paper hand wipes with or without automatic cutting of the paper in folded and non-folded form.

Generally, each apparatus comprises a housing devised to accommodate, in its upper part, a reel of wipe material rotatably mounted and guided so that it is unwound by the user manually pulling the end of the strip of paper in order to ensure, thanks to an underneath cutting device incorporated in a drive drum, the dispensing of a cut length of paper.

The above-mentioned reel of wipe material is generally wound on a hollow core that fits into end pieces or similar shapes made on the lateral flanges of the housing. These flanges are elastic enough to be pushed apart in order to fit the reel or remove the core once said reel has been completely used up. Such a mounting arrangement is described in a large number of patents filed on the behalf of the applicant, such as, merely by way of example, French Patents No. 93/04082, No. 93/14609, No. 94/04399, No. 94/06907 and No. 94/05698. The apparatus described in these various patents demonstrate the above-mentioned loading system regardless whether or not the apparatus is designed to allow the dispensing of paper in folded or non-folded form.

In the above-mentioned implementations, the reel of wipe material does not rest directly on the underneath drum which includes the device for cutting strips of material; this cutting device may, for example and merely by way of example, be that stated in the Applicant's above-mentioned French Patents.

A pressure component which is in elastic contact with the drum is used to ensure transport and retention of the strip of paper as it is unwound.

The concept of producing slide-shaped elements that allow vertical guidance and dropping of the reel of wipe material due to the effect of gravity as the reel is gradually unwound is also known in other apparatus. In this case the lateral ends of the reel have caps with a pin that engages in said slides.

In the above-mentioned types of apparatus, it has been observed that the operator has to perform a manual action in order to position the reel of wipe material either by pushing the lateral flanges apart and inserting the core into the end pieces or by positioning the reel in the guide slides by means of studs or pins that protrude from the reel.

In these implementations and, in particular, in order to position the reel between the flanges, the operator has to tentatively locate and position the reel extremely precisely on the end pieces, an operation which is not always practical. The diameter of the end pieces essentially matches the diameter of the core in order to ensure adequate strength of the assembly.

In addition, it has been observed that it is necessary that the reel that is in use must have been completely unwound in order to change the reel of wipe material otherwise material wipes could be wasted.

As part of the Applicant's previous research, the latter has envisaged the possibility of removing the used up reel of wipe material when there was still a few strips of paper to be dispensed in order to automatically replace it by a new reel of material, a so-called spare reel. In this embodiment, complex mechanisms making use of swivelling lever arm or connecting rod systems were used and made the design of the apparatus expensive. On the other hand, this arrangement made it possible to dispense the entire first reel of wipe material at the same time as unwinding of the second reel in use started as defined, for instance, in French Patents No. 83/19815 and No. 76/28387. In the latter case, the final empty core containing no material was then removed from the bottom of the apparatus and an operator could subsequently remove it in order to reload the apparatus.

SUMMARY OF THE INVENTION

Having regard to the prior art deemed to have been developed mainly by the Applicant, the purpose sought after by the present invention was to improve and simplify the loading of the reel of wipe material of an apparatus for dispensing material in folded or non-folded form regardless of the other characteristics of the apparatus and, in particular, its cutting device, its drum for driving the strip of paper and other features possibly included in the apparatus.

The second purpose sought after by the invention was to produce a device for loading the reel of wipe material that allows extremely fast intervention without special handling or attempts to centrally align the reel of wipe material relative to the apparatus and its means of support and which simultaneously offers the possibility of changing a reel when the reel of wipe material in use has not been fully used up, the reel change nevertheless allowing final dispensing of said first reel at the same time as the start of unwinding of the second reel.

A third purpose sought after by the invention was to produce a loading device having features and characteristics that are simple to produce by making them an integral part of the process for manufacturing the housing of the apparatus in order to achieve a very low cost price of the entire assembly.

Another purpose sought after by the invention was to produce a loading device capable of operating in the context of a twin-roller dispensing apparatus.

Another purpose sought after by the invention was to enable the loading device to be used for every type of apparatus for dispensing paper wipes in all applications such as hand wipes, dispensing toilet paper and dispensing paper towels in folded or non-folded form.

These purposes and others will be apparent from the following description.

The apparatus for dispensing material wipes is of the type comprising, in a housing, the accommodation of at least one reel of wipe material, underneath mechanisms, especially a drum that may or may not include a cutting device, and a pressure component that presses against the drum and between which the strip(s) of material taken from the reels of wipe material is/are to be threaded.

According to a first aspect of the invention, it includes a loading device designed so that the housing comprises lateral walls perpendicular to the rear wall and devised so that they have curved slots and at least one projecting part shaped as a cam situated at the rear end of each curved slot. Opposite each wall there is a small hinged profiled plate, each small plate comprising a retractable pin arranged opposite the wall of the housing so that it engages in, projects from or retracts from said curved receptacle slot in combination with elastic deformation of the small plate, the lower part of which is capable of movably cooperating with the projection formed on the opposite wall depending on the loading phase of the reel, said pin constituting a limit stop means of the reel of wipe material until the core of the latter is offered up opposite the pin and then constituting a means of freely suspending the core that supports the reel of material. One of the ends of the small plate has an associated elastic return means allowing limited displacement and return to its initial position. The diameter of the pin is much less than the diameter of the core.

BRIEF DESCRIPTION OF THE DRAWINGS

The object of the invention is described, merely by way of example, in the accompanying drawings in which:

FIG. 5 is a side-faced view showing how the reel of wipe material is fitted in the device, FIG. 6 is a view similar to that in FIG. 5 showing the possibility of withdrawing a reel of wipe material that has not been fully used up in the context of any need to do so.

DESCRIPTION OF THE DRAWING

In order that the present invention may more readily be understood, the following description is given, merely by way of example, reference being made to the accompanying drawings.

The device for loading a reel of material has applications in any automatic or non-automatic apparatus for dispensing material and in particular applications in the dispensing of paper hand wipes, toilet paper or paper such as paper towels in folded or non-folded form.

Figure 1:
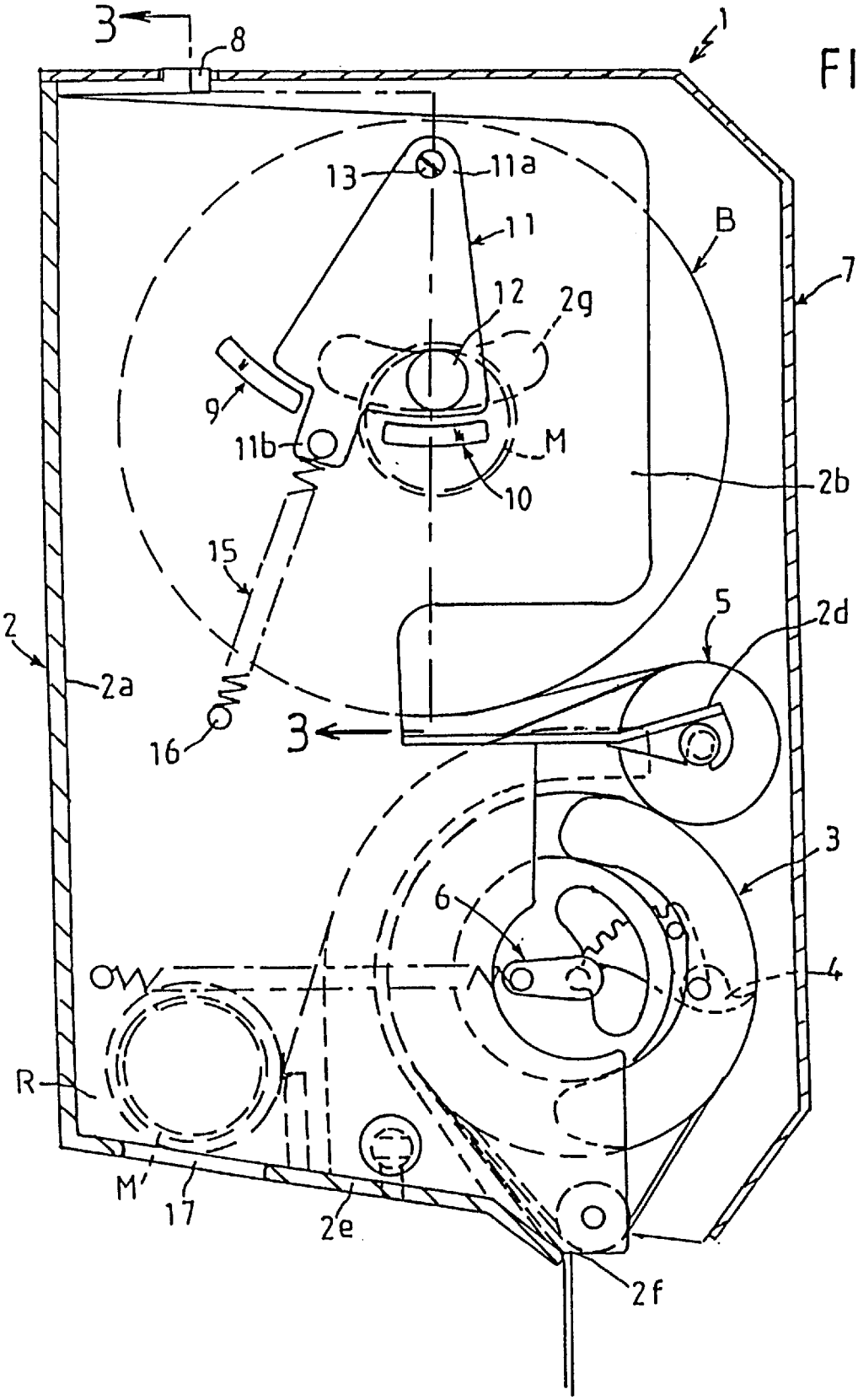
FIG. 1 is a side view of a dispensing apparatus equipped with the device for loading the reel of wipe material, a version of the apparatus is shown, merely by way of example, with features such as a drum and cutting device as described in one of the Applicant's patents.
Figure 2:
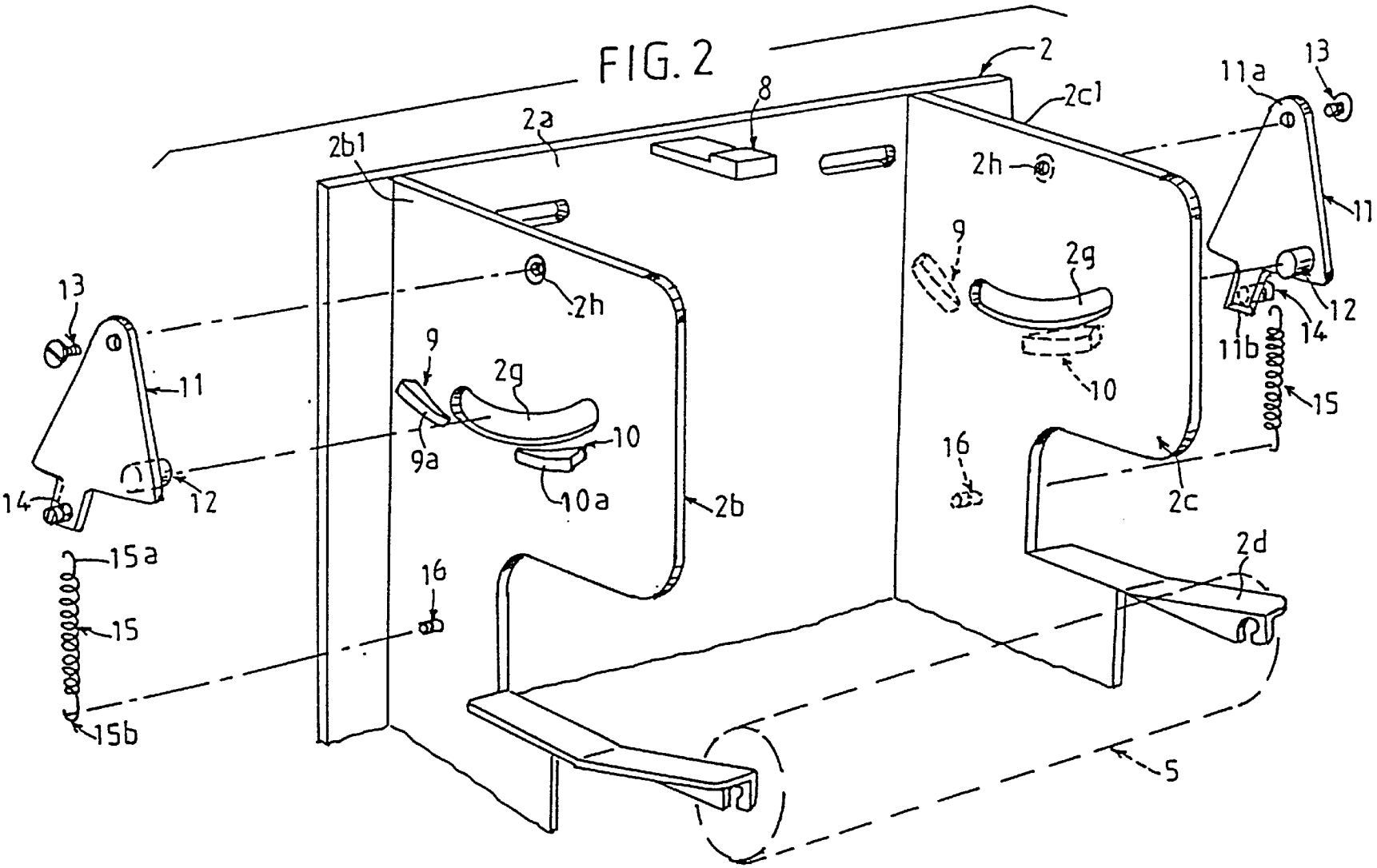
FIG. 2 is an exploded perspective view of the device for loading the reel of wipe material into a dispensing apparatus.
Figure 3:
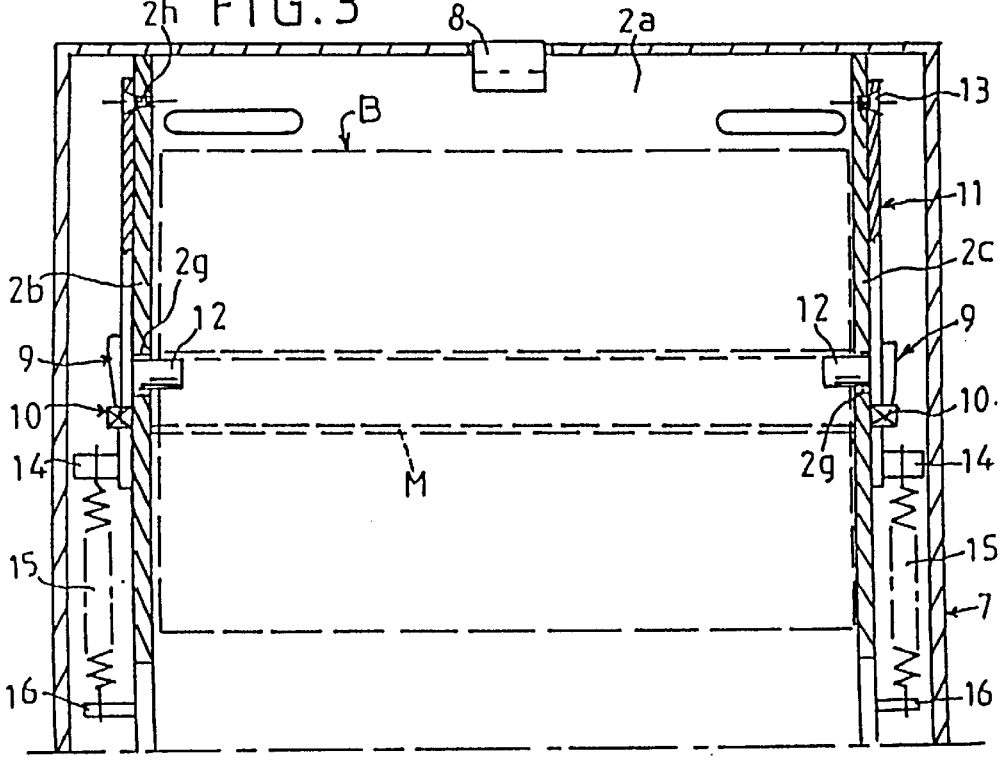
FIG. 3 is a sectional view along line 3.3 in FIG. 1 showing the reel of wipe material in its fitted position.
Figure 4:
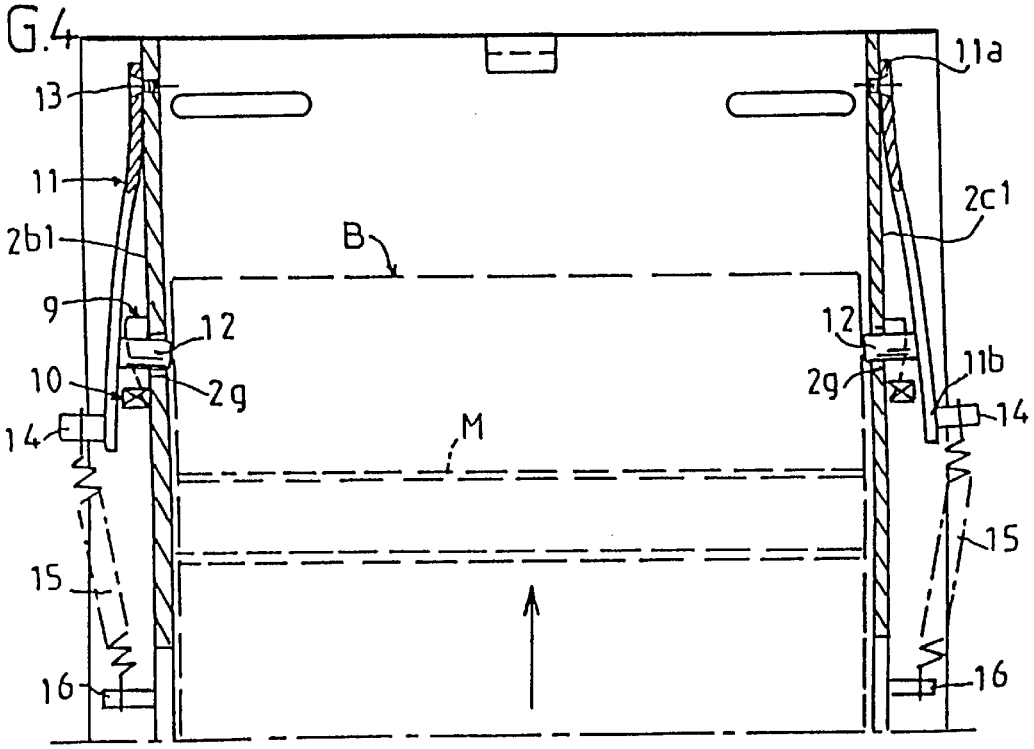
FIG. 4 is a view similar to that in FIG. 3 showing insertion or removal of the reel of wipe material.

The device for loading the reel of material is suitable for any type of apparatus for dispensing paper wipe material regardless of the special characteristics and features of the drum, the built-in or not built-in cutting device and various other features required for operation and dispensing strips of paper in preset lengths. FIG. 1 is a simple illustration of an example of a complete dispensing apparatus including all its mechanisms in order to make it easier for the reader to understand the invention based on, in particular, implementations developed by the Applicant in his previous patents.

The dispensing apparatus is referred to in its entirety as (1). It comprises a housing (2) of parallelepiped form having a rear wall (2*a*), two lateral walls (2*b*–2*c*) that are perpendicular to the rear wall and define the area for positioning the reel of wipe material (B) and underneath mechanisms, especially a drum (3) that includes a cutting device (4) as well as a pressure component (5) that presses against the drum between which the strip(s) of material taken off from the reels of wipe material is/are to be threaded as will be described later on. The pressure component is held in position by shaped tabs (2*d*) moulded at the same time as the housing or separately mounted and making it possible to hold this pressure component against the drum. An actuating mechanism (6) of the type described in one of the Applicant's previous patents produces and monitors rotation of the drum.

The housing comprises a bottom wall (2*e*) made with an opening (2*f*) that allows, in a known manner, transport and ejection of the strip of material cut to a preset length. This housing has a hinged cover (7) that can be closed and that can snap into the upper part of the apparatus, for example, with the aid of a means of locking (8) of any known type.

Figure 9:
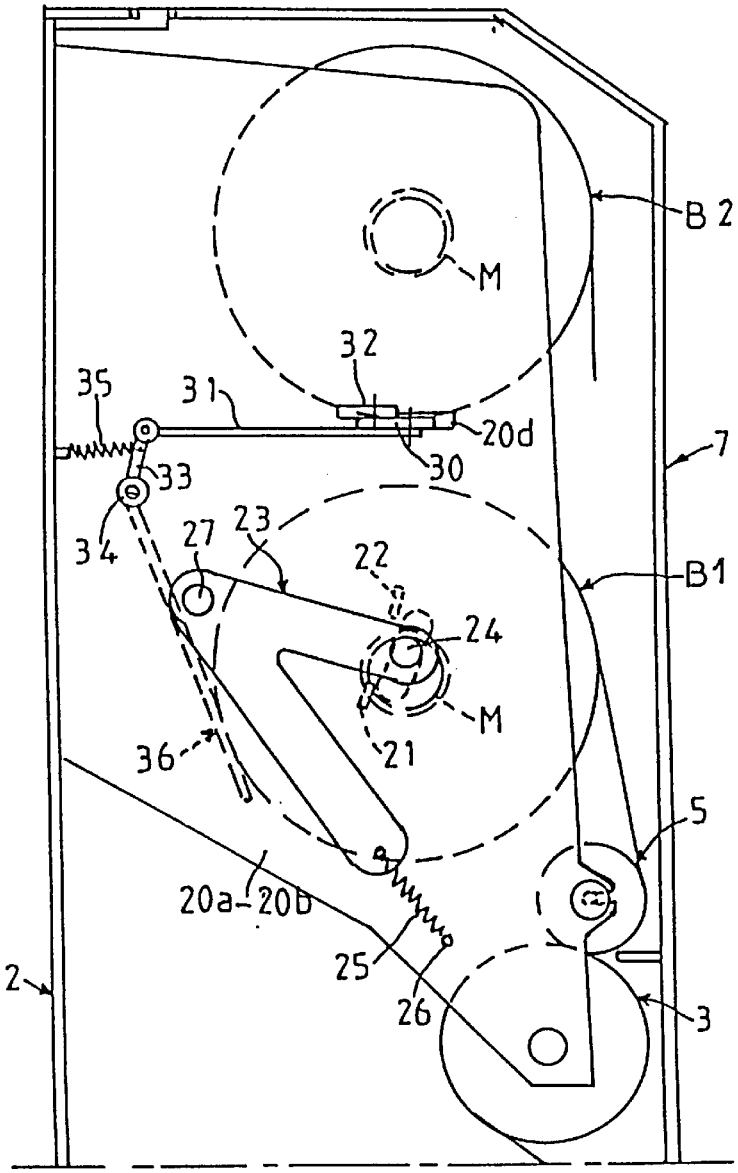
FIG. 9 is a schematic view showing use of the loading device, as in FIG. 7, applied to a twin-roller dispensing apparatus when it is not being operated.
Figure 10:
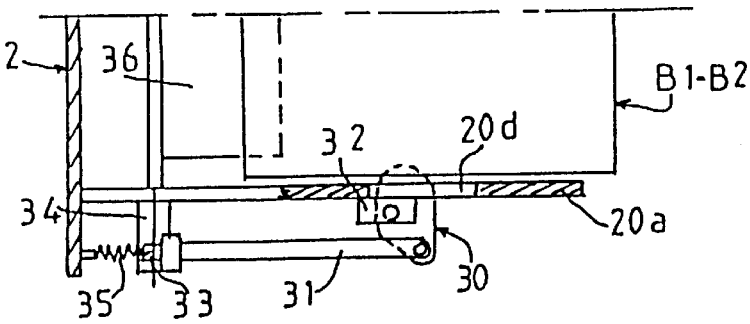
FIG. 10 is a top view, as in FIG. 9, showing the mechanism for holding and retracting the spare reel.
Figure 11:
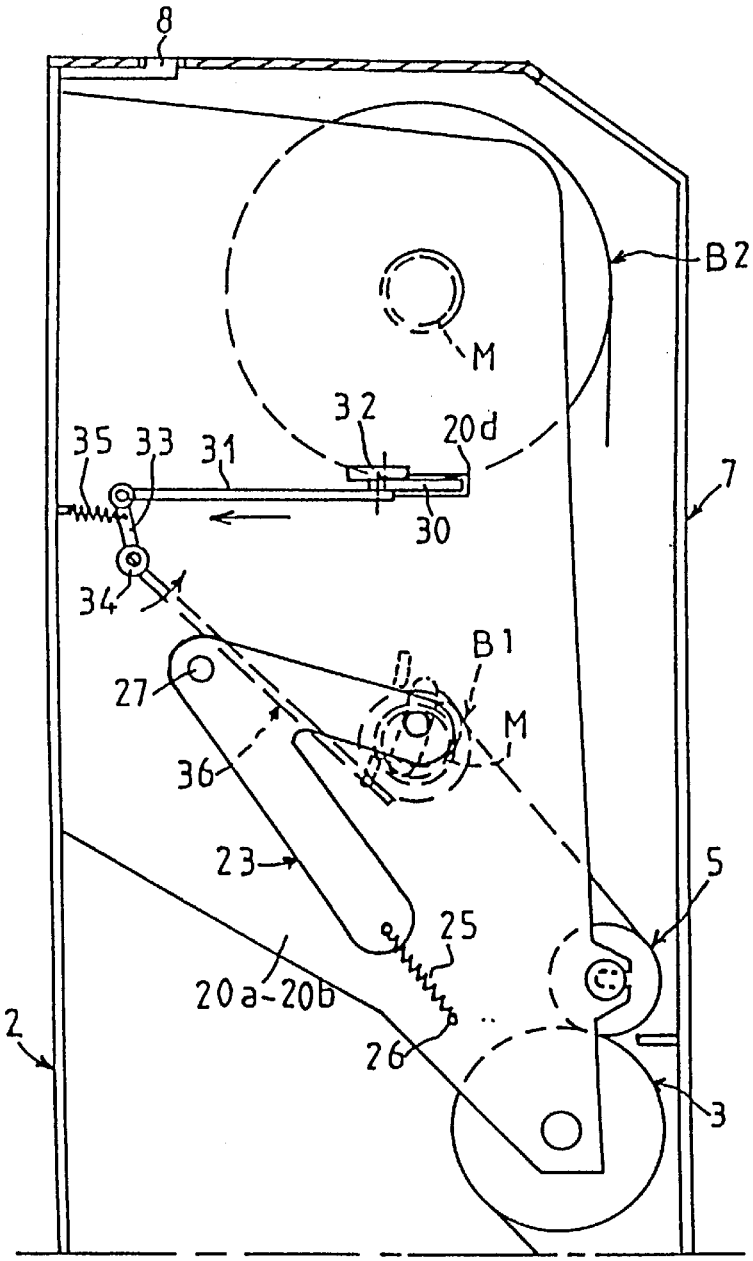
FIG. 11 is a view similar to FIG. 9 showing the detection method for changing and replacing a used up reel of material by a spare reel.
Figure 12:
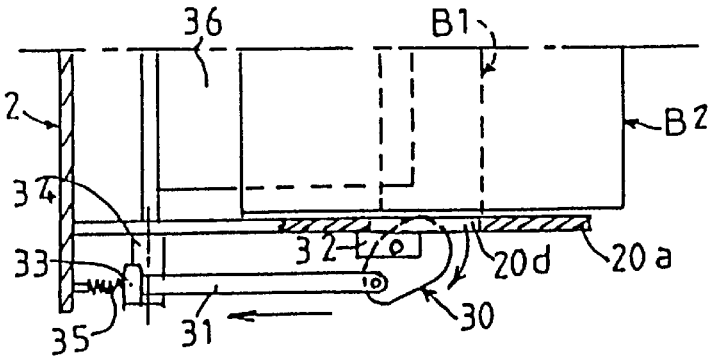
FIG. 12 is a plan view, as in FIG. 11, diagrammatically showing retraction of the mechanism for securing the spare reel.

According to the invention, the device for loading the reel of wipe material allows either horizontal insertion of the coil into the apparatus through its front as is shown in the drawings in FIGS. 2 to 6 or, in an alternative embodiment, insertion of the reel of material through the top of the apparatus in accordance with FIGS. 1 and 9. The use of a twin-roller version of the apparatus as another variation using the same loading device will be described below.

The first alternative embodiment of the device for loading the reel of material by frontal insertion into the apparatus is now described, reference being made to FIGS. 1 to 6.

In this implementation, the lateral walls (2*b*–2*c*) of the housing are each made with curved slots (2*g*) located in an essentially horizontal plane. Underneath each of these slots there is, on the outer surface (2*b*1–2*c*1) of said walls, at least one projecting shape (9) having a cam profile and placed between the rear wall (2*a*) of the housing and the end of the curved slot. This projecting shape (9) has a profile that gradually slopes (9*a*) from the rear end of the curved slot (2*g*) making it act as a cam as will be described later on.

Advantageously there is another projecting shape (10) having a sloping profile (10*a*) on each lateral side wall, this shape is located symmetrically with respect to the first projection on the other side of the curved slot, the two projections (9–10) being situated on the same outer end of each of the walls (2*b*–2*c*) and both advantageously situated on the same side as the longest straight edge.

A small profiled plate (11) that swivels relative to walls (2*b*–2*c*) and cooperates more specifically with each of the curved slots (2*g*) and the projection(s) (9–10) is then separately externally mounted on each lateral wall of the housing. This small plate is a fixed support for a pin (12) for positioning, retaining and suspending the core (M) of the reel of wipe material (B), said small plate being situated opposite the outer surface of each lateral wall of the housing. This pin (12) fits freely in the curved slot (2*g*) provided for this purpose and protrudes from the latter into the plane between said lateral walls (2*b*–2*c*). The small profiled plate (11) of triangular pendulum shape for example is attached so that its upper part (11*a*) is freely hinged on a connecting shaft (13) arranged and inserted into an opening (2*h*) formed in each of the above-mentioned lateral walls.

In addition, the lower part of the small profiled plate (11) is designed with a heel piece (11*b*) and accommodates a shaft (14) that protrudes externally opposite pin (12) and is used to support and attach the end (15*a*) of a means of return (15) of which the other end (15*b*) is attached to a protruding projection (16) located at the rear in the lower part of each lateral wall of the housing. The inner pin (12) protrudes from the above-mentioned receptacle slot over a certain distance preferably corresponding to the thickness of the slot. The small profiled plate (11) shaped like a pendulum is advantageously capable of a certain degree of elastic deformation thanks to the way it is mounted and the material of which it is made as will become evident below. The heel piece (11*b*) of the above-mentioned small plate protrudes into the lower part and is situated in a plane beyond the projections (9–10) formed externally on the lateral walls of the housing and between said projections (9–10).

The operation of the apparatus is as follows, reference being made to the drawings in FIGS. 1 to 6.

During the phase when a reel of wipe material is not being loaded, the two pendulum shaped small profiled plates (11) are in a stable position due to the effect of gravity, pin (12) is located in each of the above-mentioned curved slots whereas the heel piece (11*b*) of each small plate is situated between projections (9–10). Pin (12) protrudes slightly internally and constitutes a limit stop area. Note that the diameter of the pin (12) is much less than the diameter of the core (M) of the reel of wipe material. When the operator wishes to load a reel of wipe material in the apparatus, he offers up the reel from the front so that the external part (B1) of the reel rests against the rear of each of the pins (12) associated with the small pendulum shaped plates. By pushing in the direction of arrow (F), the small plates are pushed back towards the rear (FIG. 5). During this movement, the heel piece of each of the small plates then presses against the sloping part (9*a*) forming a ramp on projection (9) and move along the latter, thus causing lateral spreading of the small plate relative to the corresponding wall by elastic deformation, the upper part of said small plate nevertheless remaining connected to the wall by hinge pin (13). The elastic deformation of the small plate is therefore greatest in its lower part, especially opposite pin (12) which retracts and is then located in a withdrawn position inside the curved slot that accommodates it or in slight contact with the corresponding lateral side of the reel. Because this operation is simultaneous on both sides of the apparatus, it is apparent that the reel of wipe material can be inserted without any difficulty. The transverse sides of the reel then act as a backrest for each of the pins (12). When the core of the reel is inserted, regardless of its position opposite the pins (12) of each of the small plates, the latter are no longer prevented from spreading and then return to their initial position through the resilience of the small plates and penetrates inside the core. Tension spring (15) is used to return the small plate to its initial position. The reel of material is then in a position where it is suspended on above-mentioned pins (12) which penetrate partially inside the core of the reel. This produces flexible, fast fitting without any need to specially adjust the core of the reel relative to above-mentioned pins (12).

Conversely, if the operator wishes to remove the reel of wipe material that is in use for any reason, he performs the opposite operation and the apparatus is then in the configuration shown in FIG. 6. It is projections (10) that allow spreading of the small plates which have pulled forwards in the direction of arrow (F2) through the support action of the pins against the internal bottom of the core.

In this advantageous embodiment of the invention and is particularly evident in FIG. 1, a new reel of material can be loaded even if the reel that is in use has not been fully used up. On the contrary, the loading device according to the invention makes it easy to eject the reel that is running out by the pressure exerted against it by a new reel under the fitting conditions described above thus ensuring ejection of the used-up reel into the rear lower part of the housing of the apparatus designed in the form of a container (R).

This last situation allows simultaneous superposed dispensing of the remaining strip of material of the ejected reel on the one hand and, on the other hand, unwinding of the new reel. There will therefore be a strip of paper of double thickness until the first roll is used up. An opening (17) is advantageously made in the bottom of the housing so that the empty core containing no paper can be held and removed after the first reel has been completely used up.

The advantages are clearly apparent from the invention and, in particular, the simplicity of the operation of the device and the manner in which it is operated are emphasised.

Figure 7:
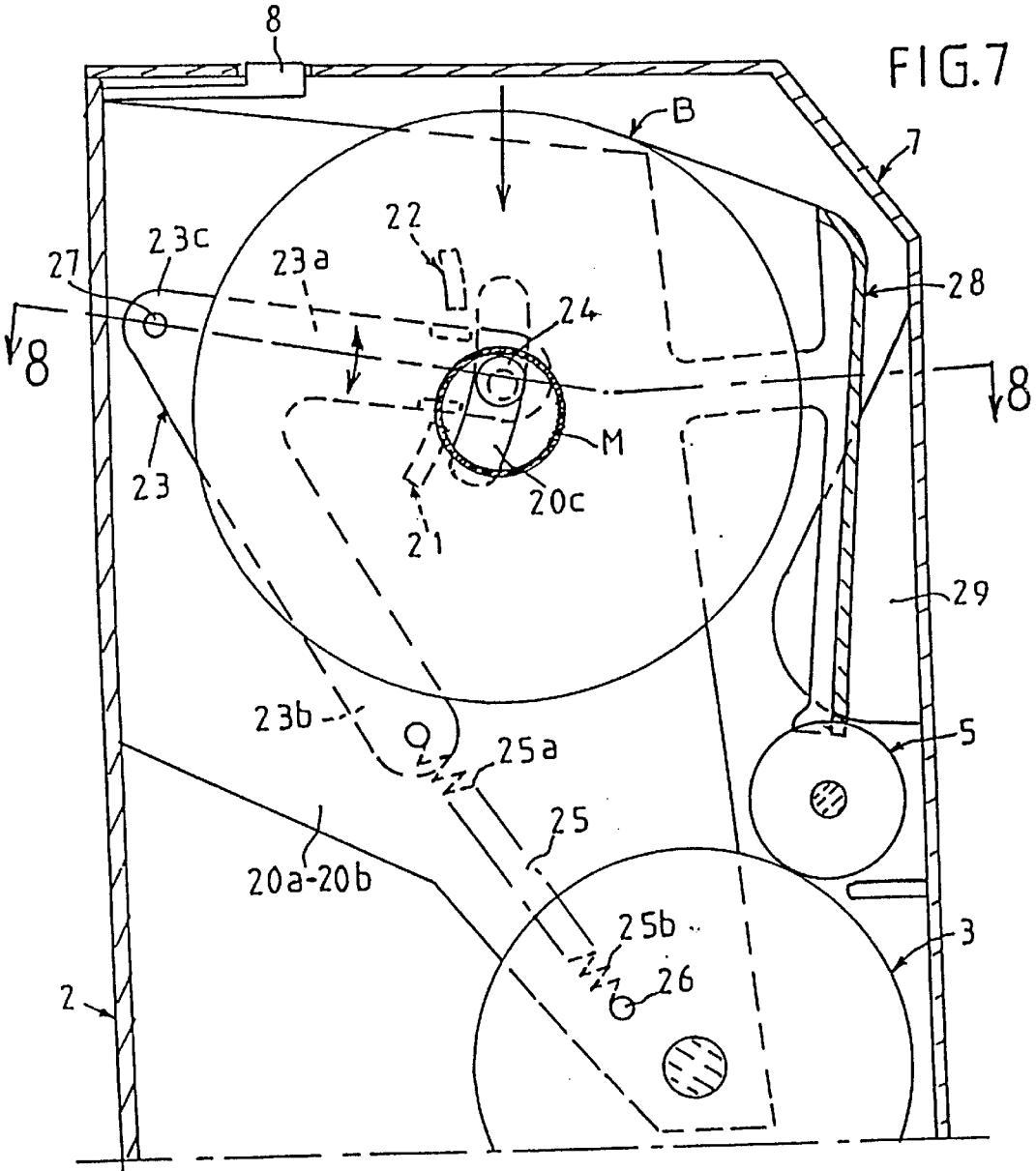
FIG. 7 is a side-faced view of a dispensing apparatus with an alternative embodiment of the loading device allowing the reel of wipe material to be inserted from the top of the apparatus and also including a support frame allowing the dispensing of paper in a folded-form version.
Figure 8:
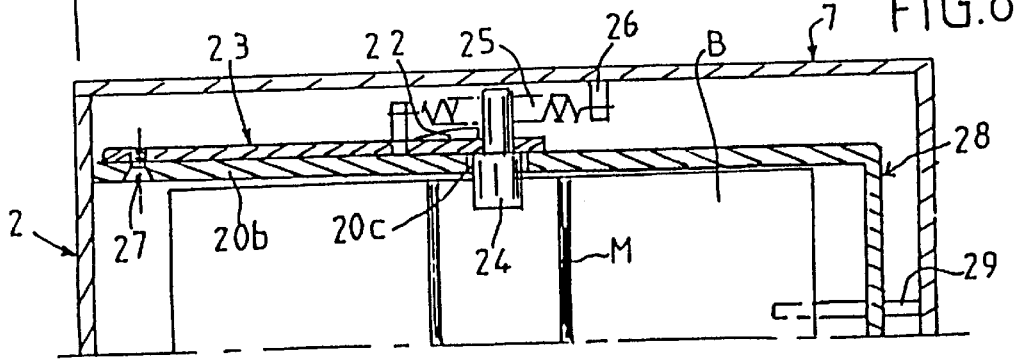
FIG. 8 is a sectional view along line 8.8 in FIG. 7.

Without going beyond the scope of the invention, one can alternatively make provision for loading the reel of wipe material from the top of the apparatus as shown, for example, in FIG. 7. In this case the lateral walls (20*a*–20*b*) of the housing (20) are also designed with curved openings (20*c*) of the same type as before but they are situated in an essentially vertical plane with two projections (21–22) equivalent to the previous ones (9–10) described in the previous embodiment. The small hinged plates (23) are devised significantly differently in this new version and are L shaped with the short leg (23*a*) in an essentially horizontal position accommodating the retractable pin (24) in the curved slot and the long leg (23*b*) used to attach the return means (25) by its ends (25*a*–25*b*) to the small plate (23) on the one hand and to the lateral walls of the housing on the other hand by a projection (26) in a fixed position. The angled part (23*c*) of the small L-shaped plate is hinged at the top of the apparatus by a shaft (27) associated with above-mentioned walls. The reel of wipe material is positioned under the same conditions as described above.

In an alternative use of the apparatus, provision has also been made to introduce a hinged support frame (28) on the lateral walls of the apparatus in the embodiment described in French Patent No. 94/04399 for dispensing paper in folded form. This support frame is retractable and cooperates with shaped ribs (29) formed on the cover of the apparatus as also described in the Applicant's previous patents referred to above.

Making reference to the drawings in FIGS. 9 to 12, note that the invention can also be applied to a dispensing apparatus with twin rolls or reels of material (B1–B2), one roll (B2) being provided as a spare. In this arrangement, the apparatus is loaded from the top under the same conditions as in FIG. 7 and there is no swivelling support frame allowing the dispensing of paper in folded form. In this embodiment the paper is dispensed in non-folded form.

Referring to the schematic representation in FIGS. 9 to 12, the spare roll (B2) rests on a retractable limit stop (30) in the top of the apparatus which is hinged by a connecting rod (31) relative to a fixed support (32) joined to one of the walls of the housing. A large opening (20*d*) is made in the lateral wall of the housing (20) to allow positioning and swivelling of above-mentioned limit stop in order to ensure its escape. In addition, the end of said connecting rod associated with the retractable limit stop cooperates with an arm (33) associated with a hinged pivot (34) in opposition to a return spring (35). At the end of the arm there is a test plate (36) that rests at the rear and underneath the reel of material (B1) that is in use. As this reel (B1) is gradually unwound, the test plate resting against the outer turn of the reel swivels in opposition to its arm and the above-mentioned return spring. When the reel has been almost fully unwound, the retractable limit stop (30) moves away and no longer supports and retains the spare reel (B2). The latter drops due to the force of gravity and actuates pin (24) associated with small plates (23) under the conditions described earlier. The spare reel takes the place of the previous reel. The first reel (B1) is ejected into the bottom of the housing. Note that the positioning of the spare reel is such that the hanging strip of paper is situated in the front of the apparatus. Thus, as it moves downwards, the hanging strip of paper will automatically be fed between the pressure component and the drum for dispensing the strip of paper.

The advantages are clearly apparent from the invention and its simplicity and many alternative uses are emphasised in particular.

What is claimed is:

1. A loading device for a dispensing apparatus for material wipes that has a housing for rotatably supporting a reel of material in a reel station, a drum mechanism mounted adjacent said reel station and a pressure means that is urged against the drum mechanism between which strips of material fed from the reel are threaded, said device further including, a pair of spaced apart side walls mounted in said housing, the space between which forms the reel station, opposed arcuate shaped slotted openings formed in the side walls, a camming means containing a first cam member mounted on each side wall adjacent the slotted opening, an elastically deformable profiled plate rotatably mounted in each side wall, each plate containing a pin that passes through the slotted opening and extends into said reel station whereby a core of a reel mounted in said reel station is supported upon said extended pins, a cam follower on each of the plates capable of engaging the first cam member as the plate is rotated in a first direction to resiliently move the plate away from the side wall and thus retract the pin associated with the plate within the reel station sufficiently to release the core, and a biasing means acting upon each plate for urging the cam follower away form said first cam member and thus extending the pin within the reel station, whereby the pins act as movable steps for engaging a reel that is inserted into the reel station and moving the cam followers over the first cam members to align the pins with the core of the reel and insert the pins into the core as the cam followers are moved in the opposite direction over the first cam member under the action of the biasing means.

2. The loading device of claim 1 wherein each cam member coacts with the lower section of a hinged plate to elastically deform the plate as the follower moves over the cam member to retract said pins.

3. The loading device of claim 2 wherein each side wall contains a second cam member positioned adjacent said slotted opening opposite said first cam member for retracting the pins when the reel is moved out of said reel station.

4. The loading device of claim 1 wherein each elastically deformable plate is hinged in a side plate of the housing about a connecting means and contains a shaft mounted in the lower part of the plate that is connected to one end of a spring means, the opposite end of said spring means being associated in one of said side walls.

5. The loading device of claim 1 wherein each elastically deformable plate is an L-shaped member having a generally horizontally disposed short leg that contains a pin and a long leg, said short leg coacting with said camming means and said slotted opening being arranged so that the reel can be inserted vertically into the reel station.

6. The loading device of claim 1 that further includes a container in said housing for receiving reels that are unloaded from the reel station without removing the remaining wipe material from a reel mounted in the reel station and are fed simultaneously between the drum and the pressure means.

7. The loading device of claim 1 that further includes a support frame mounted between the side walls of the housing that coacts with a shaped rib mounted in the housing front cover to engage the wipe material so as to dispense the wipe material in either a folded or unfolded form.

8. The loading device of claim 1 that further includes means for supporting a second reel of wipe material in said housing above the space between said side plates.

9. The loading device of claim 8 that further includes a limit stop means against which said second reel rests and a sensing means for detecting the amount of material remaining upon the first reel mounted in the reel station and retracting the limit stop means wherein the amount of material falls below a predetermined value allowing the second reel to move into the reel station to replace said first reel.

* * * * *

UNITED STATES PATENT AND TRADEMARK OFFICE

CERTIFICATE OF CORRECTION

PATENT NO. : 5,915,645
DATED : June 29, 1999
INVENTOR(S) : Maurice Granger

It is certified that error appears in the above—identified patent and that said Letters Patent is hereby corrected as shown below:

On the title page: Item

[86] PCT No.: PCT/FR96/00305

§ 371 Date: Dec. 12, 1997

Please delete the date of "Dec. 12, 1997" and please insert the date of --Sept. 12, 1997--.

On Column 8, Line 2, please delete the word "form" and please insert the word --from--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*